US010442664B2

(12) United States Patent
Schiller et al.

(10) Patent No.: US 10,442,664 B2
(45) Date of Patent: Oct. 15, 2019

(54) SYSTEMS, APPARATUSES, AND METHODS FOR ELECTRICAL GROUNDING OF TELESCOPING BOOMS

(71) Applicant: Ingo Schiller, Alexandria, VA (US)

(72) Inventors: Ingo Schiller, Alexandria, VA (US); Matthew Thoresen, Chambersburg, PA (US)

(73) Assignee: Ingo Schiller, Alexandria, VA (US)

( * ) Notice: Subject to any disclaimer, the term of this patent is extended or adjusted under 35 U.S.C. 154(b) by 442 days.

(21) Appl. No.: 15/254,622

(22) Filed: Sep. 1, 2016

(65) Prior Publication Data

US 2018/0057322 A1 Mar. 1, 2018

(51) Int. Cl.
*B66C 23/70* (2006.01)
*H01R 4/64* (2006.01)

(52) U.S. Cl.
CPC ..... *B66C 23/701* (2013.01); *H01R 4/64* (2013.01)

(58) Field of Classification Search
CPC ..... B66C 23/88; B66C 23/701; B66C 15/065; H01R 4/64; H01R 13/648
See application file for complete search history.

(56) References Cited

U.S. PATENT DOCUMENTS

| | | | | |
|---|---|---|---|---|
| 2,897,257 | A * | 7/1959 | Ingram | B66C 1/34 174/180 |
| 3,296,494 | A * | 1/1967 | Stenger, Jr. | B66C 15/065 174/7 |
| 3,516,553 | A * | 6/1970 | Reske | B66F 11/046 212/350 |
| 3,922,789 | A * | 12/1975 | Sarrell | B66C 23/905 116/202 |
| 4,679,653 | A | 7/1987 | Pasquarette, Jr. et al. | |
| 6,170,607 | B1 * | 1/2001 | Freeman | B66C 15/065 182/18 |
| 2008/0308350 | A1 | 12/2008 | Chard et al. | |
| 2013/0048425 | A1 * | 2/2013 | Thompson | B66F 17/006 182/46 |

FOREIGN PATENT DOCUMENTS

| | | |
|---|---|---|
| CN | 201211846 Y | 3/2009 |
| CN | 202449759 U | 9/2012 |
| CN | 204958192 U | 1/2016 |

* cited by examiner

*Primary Examiner* — Michael E Gallion
(74) *Attorney, Agent, or Firm* — Oblon, McClelland, Maier & Neustadt, L.L.P.

(57) ABSTRACT

Systems, methods, or apparatuses for electrically grounding telescoping booms are provided. The systems, methods, and apparatuses can involve a telescoping boom assembly comprised of a plurality of nestable boom segments, and at least one electrically conductive contact provided between each pair of adjacent or successive boom segments. Each electrically conductive contact electrically connects corresponding adjacent or successive boom segments, to provide a predictable or predetermined path of least resistance toward or to ground for current introduced to the telescoping boom by an external energizing source.

19 Claims, 6 Drawing Sheets

SYSTEMS, APPARATUSES, AND METHODS FOR ELECTRICAL GROUNDING OF TELESCOPING BOOMS

SUMMARY

Generally speaking, embodiments of the disclosed subject matter relate to systems, apparatuses, and methods for electrically grounding telescoping booms.

According to one or more embodiments of the disclosed subject matter, a mobile telescoping crane is provided. The mobile telescoping crane comprises: a carrier having a plurality of wheels or treads; a superstructure rotatably coupled to a top portion of the carrier about a vertical axis; and a telescoping boom structure rotatably coupled to the superstructure about a horizontal axis; a boom tip coupled to an end-most extension boom of the plurality of metal extension booms; and a load assembly coupled to the boom tip. The telescoping boom structure is configured to extend in a first direction to a fully extended state and retract in a second direction opposite the first direction to a fully retracted state, and includes a metal base boom and a plurality of metal extension booms arranged concentrically and spaced apart from each other. The telescoping boom structure further includes at least one first electrically conductive contact provided in a space between the metal base boom and an adjacent metal extension boom of the plurality of metal extension booms, where the at least one first electrical conductive contact is configured to maintain contact with the metal base boom and the adjacent metal extension boom so as to maintain electrical continuity between the metal base boom and the adjacent metal extension boom in the fully extended state, the fully retracted state, and any state of the telescoping boom structure between the fully extended state and the fully retracted state. The telescoping boom structure also includes at least one second electrically conductive contact provided in respective spaces between adjacent metal extension booms of the plurality of metal extension booms, wherein the at least one second electrically conductive contact is configured to maintain contact with the adjacent metal extension booms so as to maintain electrical continuity between the adjacent metal extension booms in the fully extended state, the fully retracted state, and any state of the telescoping boom structure between the fully extended state and the fully retracted state. The telescoping boom structure is configured to provide a predictable, continuous ground path for current from the telescoping boom structure to at least the superstructure for an external high voltage source applied to the telescoping boom structure.

One or more embodiments of the disclosed subject matter also provide a telescoping boom. The telescoping boom is comprised of a first boom segment; a second boom segment inwardly spaced from the first boom segment; and at least one electrically conductive contact provided between the first boom segment and the second boom segment. The second boom segment is nestable within an inner volume of the first boom segment and movable between a fully extended position and a fully retracted position relative to the first boom segment. The at least one electrically conductive contact is fixed to at least one of the first boom segment and the second boom segment and configured to maintain an electrical conduction path between the first boom segment and the second boom segment in the fully extended position, the fully retracted position, and any position between the fully extended position and the fully retracted position. The at least one electrically conductive contact is configured to provide a predictable, continuous ground path for current from the first boom segment to the second boom segment for an external voltage applied to the second boom segment.

According to one or more embodiments of the disclosed subject matter, an electrically conductive contact for a telescoping boom having a first boom segment, and a second boom segment inwardly spaced from the first boom segment is provided. The electrically conductive contact comprises a body having a first side configured to make a first electrical connection with the first boom segment, and a second side configured to make a second electrical connection with the second boom segment. The first electrical connection and the second electrical connection form a predetermined portion of a ground path from the second boom segment to the first boom segment upon energization of the second boom segment caused by an external energization source applied to the second boom segment.

Aspects also include methods of providing and/or using a mobile telescoping crane, a telescoping boom, and electrically conductive contact as described and claimed herein.

Other features and aspects of this disclosure will be apparent from the following description and the accompanying drawings.

BRIEF DESCRIPTION OF THE DRAWINGS

The accompanying drawings, which are incorporated in and constitute a part of the specification, are illustrative of one or more embodiments and, together with the description, explain the embodiments. The accompanying drawings have not necessarily been drawn to scale. Further, any values or dimensions in the accompanying drawings are for illustration purposes only and may or may not represent actual or preferred values or dimensions. Where applicable, some or all select features may not be illustrated to assist in the description and understanding of underlying features.

Figure 1:
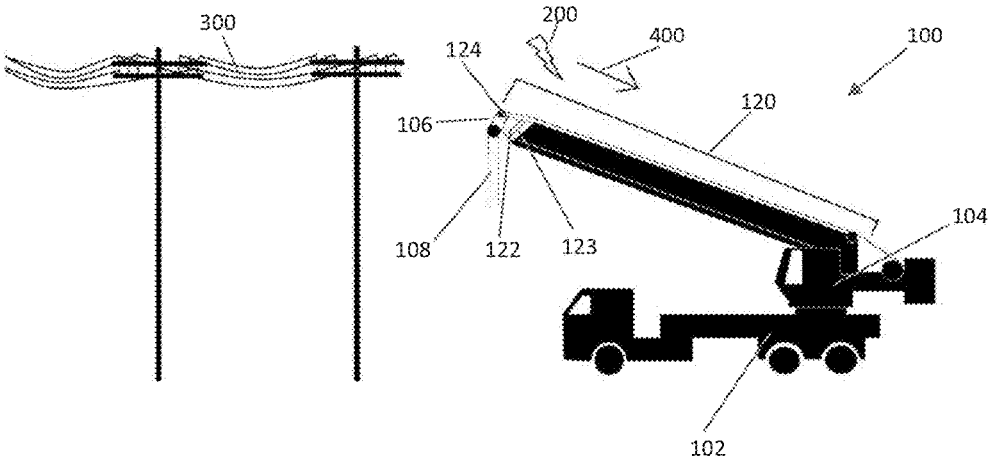
FIG. 1 is a diagram of a mobile telescoping crane according to one or more embodiments of the disclosed subject matter.

Other features and aspects of this disclosure will be apparent from the following description and the accompanying drawings.

DETAILED DESCRIPTION

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, structures and components may be shown in block diagram form in order to avoid obscuring the concepts of the described subject matter. Wherever possible, corresponding or similar reference numbers will be used throughout the drawings to refer to the same or corresponding parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural references unless the context clearly dictates otherwise. That is, unless clearly specified otherwise, as used herein the words "a" and "an" and the like carry the meaning of "one or more." Additionally, it is to be understood that terms such as "left," "right," "up," "down," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Generally speaking, embodiments of the disclosed subject matter involve systems, methods, or apparatuses for electrically grounding telescoping booms. More specifically, embodiments of the disclosed subject matter can involve providing a predictable or predetermined continuous path of least resistance, of appropriate capacity, toward or to ground for an externally-generated current resulting from an external energizing source applied to the telescoping boom.

According to one more embodiments of the disclosed subject matter, a telescoping boom assembly comprises of a plurality of nestable boom segments and at least one electrically conductive contact provided between at least one pair of adjacent or successive boom segments, where each electrically conductive contact electrically connects corresponding adjacent or successive boom segments, to provide a predictable or predetermined continuous path of least resistance through the corresponding portion of portions of the telescoping boom assembly toward or to ground for current resulting from unexpected energization of the telescoping boom assembly by an external energization event, such as a lightning strike to the telescoping boom assembly or inadvertent proximity (e.g., contact) of the telescoping boom assembly to a power line (e.g., a high-voltage power line) or other external voltage source.

Thus, embodiments of the disclosed subject matter can provide formation of a common path, of a high-enough current-carrying capacity, for current to flow toward or to ground from anywhere along the telescoping boom assembly, thereby safely dissipating to ground or to a grounded underlying chassis (e.g., grounded using a cable electrically tethered to the chassis and a conductive spike driven into the ground, for instance) the current introduced to the telescoping boom assembly by an external energizing source. Consequently, possibly harmful current from the external energizing source may not travel along an undesired or unpredictable path, which may prevent damage to system components and/or injury to an operator or bystander.

Turning to the figures, FIG. 1 is a diagram of system, according to one or more embodiments of the disclosed subject matter, in the form of a mobile telescoping crane 100. Of course, though FIG. 1 and corresponding portions of the description pertain to mobile telescoping crane 100, embodiments of the disclosed subject matter are not limited to telescoping cranes, let alone mobile telescoping cranes, and can include or be implemented in any machine having a telescoping boom, or the like, such as a crane (mobile or stationary) or a man-lift (mobile or stationary).

Generally, the mobile telescoping crane 100 can comprise a carrier 102, which may have a plurality of wheels, a superstructure 104, which may be rotatably coupled to the carrier 102 about a vertical axis. The carrier 102 and/or the superstructure 104 may be referred to as a chassis of the mobile telescoping crane 100. The mobile telescoping crane can also be comprised of a telescoping boom structure 120, which may be rotatably coupled to the superstructure 104 about a horizontal axis to change an angle of the telescoping boom structure 120 between a predetermined angle range, a boom tip 106 coupled to an end-most extension boom 124 of a plurality of extension booms 122, which may be made of metal, and a load assembly 108 coupled to the boom tip 106.

Generally speaking, the telescoping boom structure 120 can be comprised of a plurality of extension tubes (i.e., booms 122) fitted one inside the other or nested, in a spaced relationship such that at least sidewalls thereof do not contact adjacent extension booms 122 in a fully retracted state, a fully extended state, and/or any state of the extension tubes between the fully retracted state and the fully extended state. A hydraulic or other powered mechanism can extend and/or retract the extension booms 122 to increase or decrease the total length of the telescoping boom structure 120.

In the event that the telescoping boom structure 120 becomes energized from an external energizing event, such as a lightning strike 200 to the telescoping boom structure 120 or inadvertent proximity (e.g., contact) of the telescoping boom structure 120 to a power line 300 or other external voltage source, any resulting current 400 can follow a predictable, continuous path of least resistance through the telescoping boom structure 120 toward ground. In this regard, the chassis of the mobile telescoping crane 100, i.e., the carrier 102 and/or the superstructure 104, may be grounded, for example, via a tether to ground. Thus, in one or more embodiments of the disclosed subject matter, the predictable, continuous path of least resistance through the telescoping boom structure 120 toward ground may continue to a ground path of the chassis that leads to ground (i.e., the chassis itself may be grounded). Additionally or alternatively, a base boom 123 of the extension booms 122 may be connected to ground, for instance, by a cable electrically tethered to the base boom 123 and a conductive spike driven into the ground. Thus, the current from an external energizing event may pass through at least a portion of the telescoping boom structure 120 and routed to ground so as to bypass the chassis. Of course, the boom tip 106 and the end-most extension boom 124 can be in electrical continuity such that an external energizing event at the boom tip 106 can predictably route current to the telescoping boom structure 120 and the predictable, continuous path of least resistance to ground provided by the telescoping boom structure 120.

The predictable, continuous path of least resistance of the telescoping boom structure 120 can be provided by electrical coupling together of extension booms 122. More specifically, adjacent extensions booms 122 can be electrically coupled together to form a predictable, continuous path of least resistance of suitable capacity for current to flow to or toward ground.

Electrical coupling of the extension booms 122 can be implemented by at least one electrically conductive contact provided in a space between adjacent extension booms. Generally speaking, the electrically conductive contacts can provide electrical continuity between adjacent extension booms 122 when the telescoping boom structure 120 is in an extended state, such as a fully extended state. The electrically conductive contacts can also provide electrical continuity between adjacent extension booms 122 when the telescoping boom structure 120 is in a non-extended state, such as a fully retracted state, and/or when the telescoping boom structure 120 is in a state where only one or more of the extension booms 122 is in an extended state (e.g., fully extended) and one or more of the extension booms 122 is in a non-extended state (e.g., a fully retracted state). Further, the electrically conductive contacts can maintain electrical continuity between adjacent extension booms 122 when the extension booms 122 are moving between fully extended and fully retracted states.

Electrically conductive contacts according to embodiments of the disclosed subject matter may be permanently or removably coupled to adjacent extension booms 122. Thus, in one or more embodiments of the disclosed subject matter, electrically conductive contacts can be installed as a retrofit to an existing telescoping boom structure. Alternatively, electrically conductive contacts can be installed when manufacturing a telescoping boom structure. Additionally, the electrically conductive contacts may be configured to expendable relative to each external energizing event. As such, depending upon where on the telescoping boom structure 120 the external energizing event originated, some or all of the electrically conductive contacts may need to be replaced prior to another external energizing event. Alternatively, the electrically conductive contacts may be used for multiple external energizing events. Of course, in one or more embodiments of the present disclosure, all of the electrically conductive contacts may have the same configuration. Alternatively, the electrically conductive contacts may have different configurations. Additionally, in one or more embodiments of the disclosed subject matter, the electrically conductive contacts may include or operate with conductive grease.

FIGS. 2-8 illustrate non-limiting examples of electrically conductive contacts according to embodiments of the disclosed subject matter.

Figure 2:
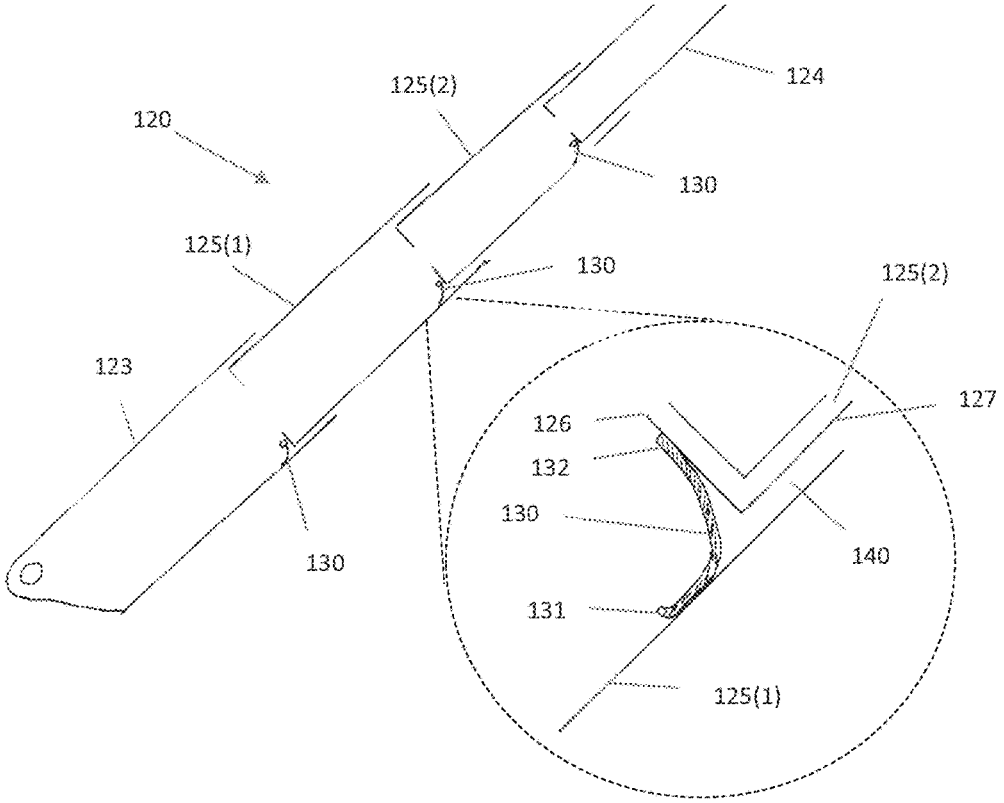
FIG. 2 is an illustration of a portion of an electrically coupled telescoping boom structure according to one or more embodiments of the disclosed subject matter.

Turning to FIG. 2, this figure is an illustration of a portion of an electrically coupled telescoping boom structure 120 according to one or more embodiments of the disclosed subject matter.

FIG. 2 shows the boom structure 120 having base boom 123, end-most extension boom 124, and a plurality of intermediate extension booms 125. Though FIG. 2 shows two intermediate extension booms 125, only one or more than two intermediate extension booms 125 may be provided. The boom structure 120 can also include at least one electrically conductive contact 130 electrically connecting adjacent extension booms 122 (including the base boom 123). Each conductive contact 130 may be a wire or flexible contact element, such as a biased spring contact element, configured to maintain electrical contact with adjacent extension booms 122 in a fully extended state, a fully retracted state, and/or any state between the fully extended state and the fully retracted state.

Referring to the enlarged section of FIG. 2, the electrically conductive contact 130 can be fixed, for example, tethered, to at least one of the intermediate extension booms 125(1), 125(2). Further, the electrically conductive contact 130 can be configured to always be in electrical contact with both intermediate extension boom 125(1) and intermediate extension boom 125(2). For example, electrically conductive contact 130 may have a first end 131 fixed to an inner surface of the intermediate extension boom 125(1) and have a second end 132 biased so as to press against the intermediate extension boom 125(2).

In the extended arrangement or state illustrated in FIG. 2, the second end 132 of electrically conductive contact can contact an end surface 126 of the intermediate extension boom 125(2). Thus, electrically continuity is provided between the intermediate extension boom 125(1) and the intermediate extension boom 125(2) via the electrical connections of the first end 131 and the second end 132 of the electrically conductive contact 130 with the intermediate extension boom 125(1) and the intermediate extension boom 125(2), respectively.

When the intermediate extension boom 125(2) retracts into intermediate extension boom 125(1), the electrically conductive contact 130 can bend so as to be provided in a space 140 between the intermediate extension boom 125(2) and the intermediate extension boom 125(2), but can maintain contact with the intermediate extension boom 125(2). That is, the second end 132 of the electrically conductive contact 130 can maintain electrical contact with an outer surface 127 of the intermediate extension boom 125(2). When the intermediate extension boom 125(2) is extended, the second end 132 of the electrically conductive contact 130 can slide along the outer surface 127 of the intermediate extension boom 125(2) and revert to biased electrical contact with the end surface 126 of the intermediate extension boom 125(2).

In an alternative embodiment, the second end 132 of electrically conductive contact can be fixed to end surface 126 of the intermediate extension boom 125(2), and the first end 131 of the electrically conductive contact 130 can be biased so as to always maintain contact with the inner surface of the intermediate extension boom 125(1). Further, the electrically conductive contact 130 can slide along the inner surface of the intermediate extension boom 125(1) such that electrical contact is maintained between the electrically conductive contact 130 and the intermediate extension boom 125(1).

Figure 3:
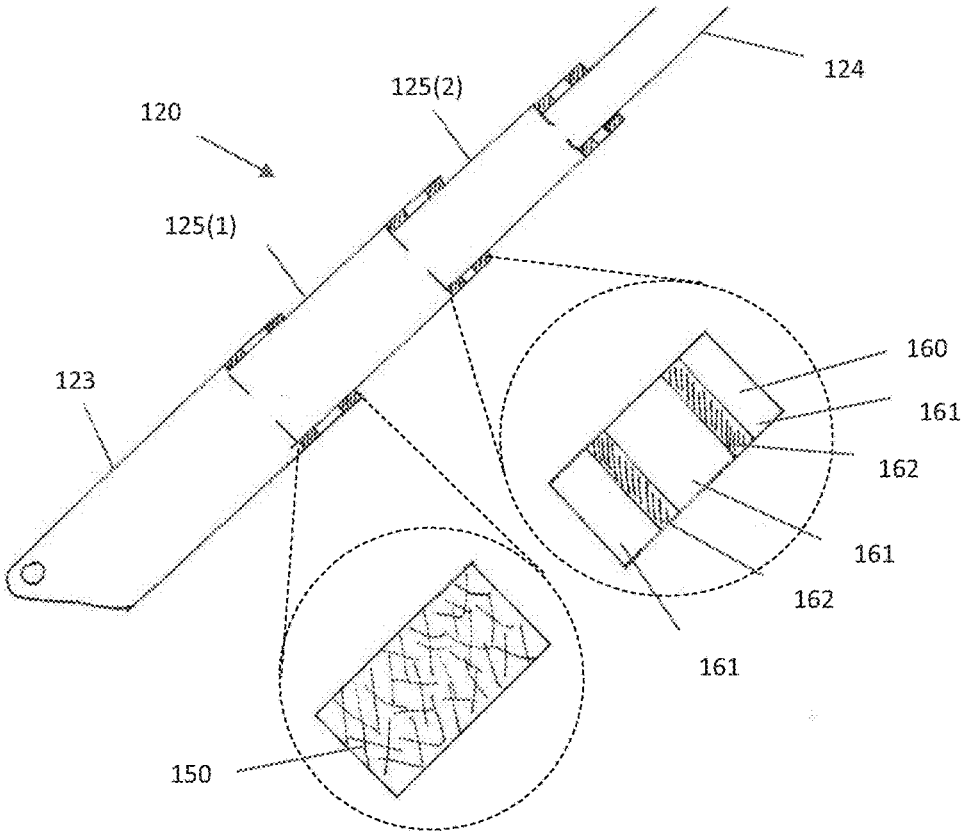
FIG. 3 is an illustration of a portion of an electrically coupled telescoping boom structure according to one or more embodiments of the disclosed subject matter.

Turning now to FIG. 3, this figure is an illustration of a portion of an electrically coupled telescoping boom structure 120 according to one or more embodiments of the disclosed subject matter.

As with FIG. 2, the boom structure 120 can have base boom 123, end-most extension boom 124, and a plurality of intermediate extension booms 125. Though FIG. 3 shows two intermediate extension booms 125, only one or more than two intermediate extension booms 125 may be provided.

Further, the boom structure 120 can also include at least one electrically conductive contact 150 or 160 electrically connecting adjacent extension booms 122 (including the base boom 123). For example, each electrically conductive contact 150, 160 may be provided between adjacent extension booms 122, for instance, between an inner surface of an outer-most extension boom 122 (e.g., extension boom 125 (2)) and an outer surface of an inner-most extension boom 122 (e.g., extension boom 124) of the adjacent pair. Further, the electrically conductive contact 150, 160 may be fixedly coupled to the outer-most extension boom 122, for instance, and the inner-most extension boom 122 can slide along the electrically conductive contact 150, 160 such that electrical contact is maintained as the inner-most extension boom 122 is extended and retracted from the outer-most extension boom 122.

Though FIG. 3 illustrates electrically conductive contact 150 and electrically conductive contact 160, one or more embodiments may include only electrically conductive contacts in the form of electrically conductive contacts 150. Alternatively, one or more embodiments may include only electrically conductive contacts in the form of electrically conductive contacts 160. Of course, both may be used in one or more embodiments of the disclosed subject matter, either between each adjacent extension booms 122 or one between one pair of adjacent extension booms 122 and another between another pair of adjacent extension booms 122.

Each electrically conductive contact 150 or 160 can operate as a support element configured to provide mechanical support between adjacent extension booms. For example, each electrically conductive contact 150 or 160 may be a bearing media, such as a wear pad, to maintain a space or distance between adjacent extension booms 122. Further, the bearing media may provide a reduced frictional surface for the extension booms 122 as the extension booms 122 extend and retract.

Electrically conductive contact 150 of FIG. 3 may be a supporting element between adjacent extension booms 122 comprised of a bearing material and conductive fiber constitution that can provide mechanical support and electrical contact between adjacent extension booms 122. That is, the bearing material and conductive fiber medium can be of suitable size and capacity to provide mechanical support, as well as electrical continuity between the adjacent extension booms 122 with current carrying capacity to allow electricity to pass between the adjacent extension booms 122.

Electrically conductive contact 160 of FIG. 3 may be a supporting element between adjacent extension booms 122 comprised of a bearing portion or portions 161 and one or more distinct electrical conductor portions 162. The supporting element comprised of bearing portion or portions 161 and one or more distinct electrical conductor portions 162 can provide mechanical support and electrical contact between adjacent extension booms 122. That is, the bearing portion or portions 161 and one or more distinct electrical conductor portions 162 can be of suitable size and capacity to provide mechanical support, as well as electrical continuity between the adjacent extension booms 122 with current carrying capacity to allow electricity to pass between the adjacent extension booms 122.

Figure 4:
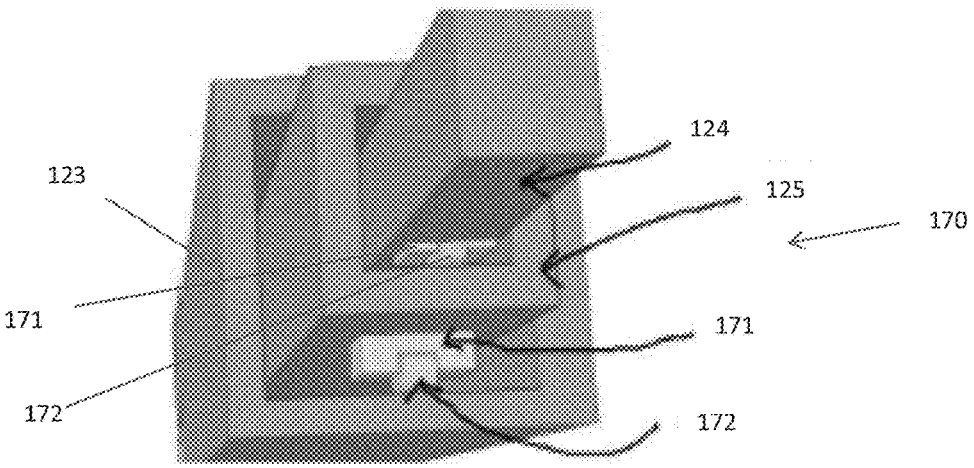
FIG. 4 shows an electrical coupling assembly for a telescoping boom structure according to one or more embodiments of the disclosed subject matter.

FIG. 4 shows an electrical coupling assembly for a telescoping boom structure according to one or more embodiments of the disclosed subject matter.

The electrical coupling assembly illustrated in FIG. 4 includes at least one electrically conductive contact 170 having a conductive base 171 and a conductive wheel 172. FIG. 4 illustrates two electrically conductive contacts 170, one between end-most extension boom 124 and intermediate extension boom 125, and one between intermediate extension boom 125 and base boom 123. Of course, more than one electrically conductive contact 170 may be provided between each pair of adjacent booms. For example, another electrically conductive contact 170 may be provided on sides of the intermediate extension boom 125 and the end-most extension boom 124 opposite those shown in FIG. 4 with electrically conductive contact 170.

FIG. 4 illustrates conductive base 171 coupled to an inner-most boom of the adjacent pairs and the conductive wheel 172 making electrical contact with an outer-most boom of the adjacent pairs. However, the configuration may be reversed. That is, the conductive base 171 may be coupled to an outer-most boom of the adjacent pairs and the conductive wheel 172 may make electrical contact with an inner-most boom of the adjacent pairs. Additionally, the electrically conductive contacts 170 may be generally of the same configuration, but different in size, for instance, sized based on the size and/or space of the adjacent booms. For example, the size of some or all of the components of the electrically conductive contacts 170 (e.g., conductive base 171 and a conductive wheel 172) may decrease from the electrically conductive contact 170 between the end-most extension boom 124 and the intermediate extension boom 125 down the boom structure 120 to the electrically conductive contact 170 between the intermediate extension boom 125 and the base boom 123.

The conductive wheel(s) 172 may ride along an adjacent boom when the booms are extended and retracted. Thus, the conductive wheel 172 can provide relatively small mechanical resistance while still providing electrical continuity between adjacent booms. Further, the conductive wheel 172 may be in a track (not expressly shown) of the adjacent boom or free spin against the boom. Additionally, in or more embodiments of the disclosed subject matter, the conductive wheel 172 may act as a guide and hold a conductive media adjacent the conductive wheel 172, where the conductive media can operate as an air gap for high voltage between the adjacent booms.

Figure 5:
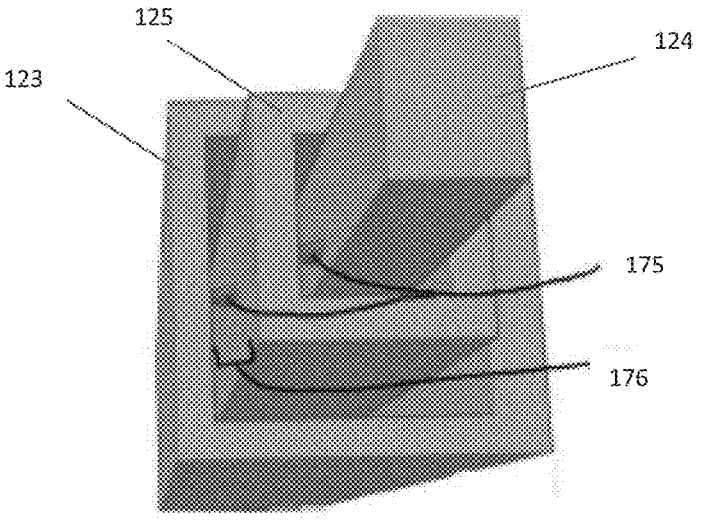
FIG. 5 shows an electrical coupling assembly for a telescoping boom structure according to one or more embodiments of the disclosed subject matter.

FIG. 5 shows an electrical coupling assembly for a telescoping boom structure according to one or more embodiments of the disclosed subject matter.

The electrical coupling assembly illustrated in FIG. 5 can include at least one electrically conductive "contact" having one or more conducting studs 175. FIG. 5 illustrates two electrically conductive studs 175, one between end-most extension boom 124 and intermediate extension boom 125, and one between intermediate extension boom 125 and base boom 123. Of course, more than one electrically conductive stud 175 may be provided between each pair of adjacent booms. For example, another electrically conductive stud 175 may be provided on sides of the intermediate extension boom 125 and the end-most extension boom 124 opposite those shown in FIG. 5 with electrically conductive studs 175.

Generally speaking, the electrically conductive studs 175 can provide a path for an electrical arc to follow. That is, as noted above, electrically conductive studs 175 may extend from either an inner-most boom of the adjacent pairs or an outer-most boom of the adjacent pairs, but may not contact the other boom of the adjacent boom pair. The gap 176 between the electrically conductive studs 175 can operate as a specified air gap for high voltage to follow. Thus, the electrically conductive studs 175 can provide a ground path, but may not contact one of the adjacent booms of the pair, thereby preventing physical contact with that boom.

Figure 6:
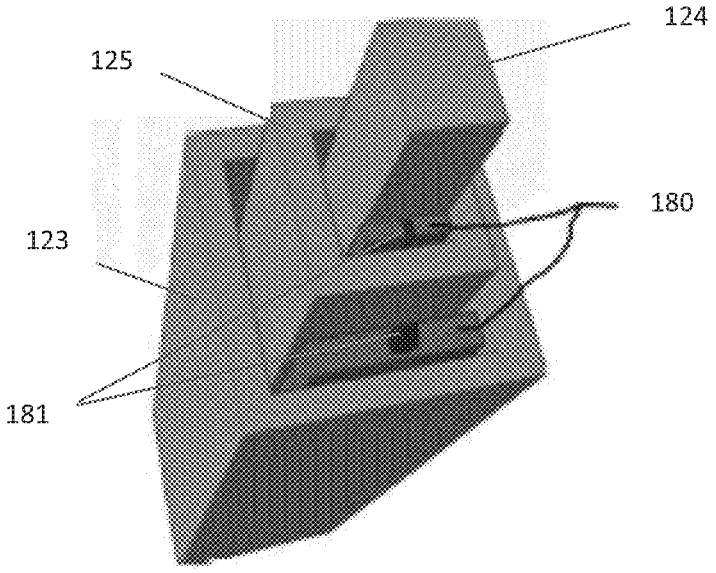
FIG. 6 shows an electrical coupling assembly for a telescoping boom structure according to one or more embodiments of the disclosed subject matter.

FIG. 6 shows an electrical coupling assembly 180 for a telescoping boom structure according to one or more embodiments of the disclosed subject matter.

The electrical coupling assembly illustrated in FIG. 6 can include at least one electrically conductive contact having one or more electrically conductive wear pad 180. FIG. 6 illustrates two electrically conductive wear pads 180, one between end-most extension boom 124 and intermediate extension boom 125, and one between intermediate extension boom 125 and base boom 123. Of course, more than one electrically conductive wear pad 180 may be provided between each pair of adjacent booms. For example, another electrically conductive wear pad 180 may be provided on sides of the intermediate extension boom 125 and the end-most extension boom 124 opposite those shown in FIG. 6 with electrically conductive wear pads 180.

Generally, wear pads 180 can operate as a mechanical lubricant between adjacent booms for when the booms extend and retract. A wear pad 180 according to embodiments of the disclosed subject matter can also include one or more electrical conductors 181 configured to provide electrical continuity between adjacent booms.

Figure 7:
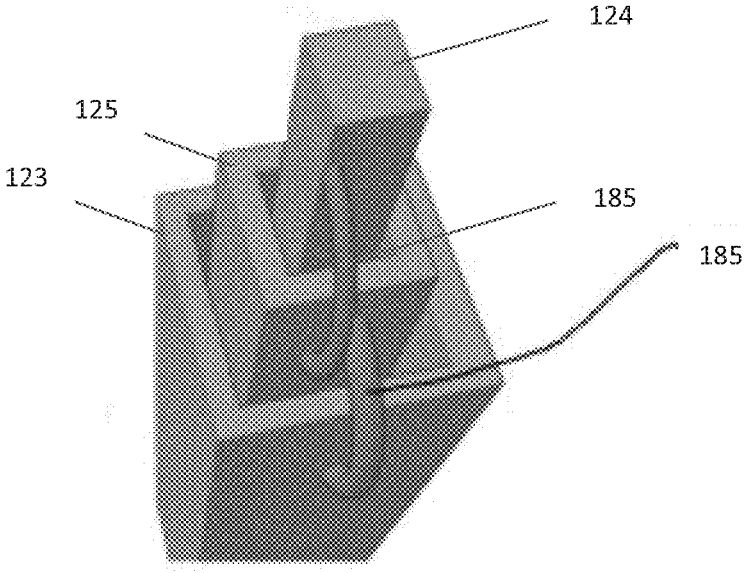
FIG. 7 shows an electrical coupling assembly for a telescoping boom structure according to one or more embodiments of the disclosed subject matter.

FIG. 7 shows an electrical coupling assembly 185 for a telescoping boom structure according to one or more embodiments of the disclosed subject matter.

The electrical coupling assembly illustrated in FIG. 7 can include at least one electrically conductive cable 185 tethered to adjacent booms. FIG. 7 illustrates two electrically conductive cables 185, one between end-most extension boom 124 and intermediate extension boom 125, and one between intermediate extension boom 125 and base boom 123. Of course, more than one electrically conductive cable 185 may be provided between each pair of adjacent booms. For example, another electrically conductive cable 185 may be provided on sides of the intermediate extension boom 125 and the end-most extension boom 124 opposite those shown in FIG. 7 with electrically conductive cables 185.

Generally speaking, each electrically conductive cable 185 may be coupled between adjacent booms using a cable reel, for instance, which can allow the conductive cables 185 to reel in and out when a corresponding extension boom is retracted and extended, respectively. Such configuration may keep tension on the cable and reduce slack. Alternatively, the conductive cables 185 may be free floating in the sense that ends are coupled to adjacent booms and the middle of the conductive cable 185 can move freely. Further, the conductive cables 185 may be inside or outside the boom structure 120. Additionally, the conductive cables 185 may be connected to outer surfaces of adjacent booms, such as illustrated in FIG. 7. Alternatively, the conductive cables 185 may be connected between an outer surface of an inner boom of the adjacent pairs and an inner surface of an outer boom of the adjacent pairs.

Figure 8:
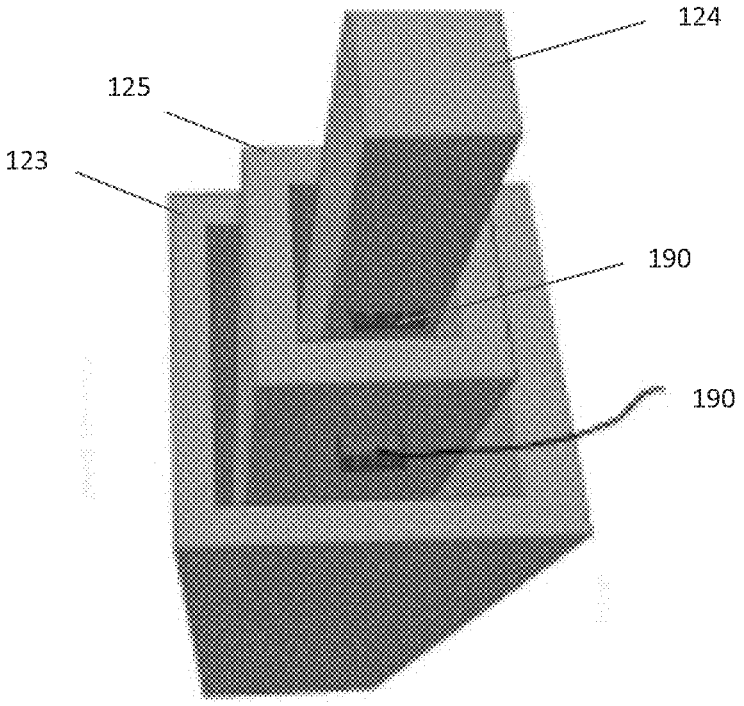
FIG. 8 shows an electrical coupling assembly for a telescoping boom structure according to one or more embodiments of the disclosed subject matter.

FIG. 8 shows an electrical coupling assembly for a telescoping boom structure according to one or more embodiments of the disclosed subject matter.

The electrical coupling assembly illustrated in FIG. 8 can include at least one electrically conductive contact having one or more brushes 190. Generally speaking, electrically conductive brushes 190 according to embodiments of the disclosed subject matter can provide relatively minimal friction force between the adjacent booms when the booms extend and retract, but can maintain electrical continuity between the adjacent booms.

FIG. 8 illustrates two electrically conductive brushes 190, one between end-most extension boom 124 and intermediate extension boom 125, and one between intermediate extension boom 125 and base boom 123. Of course, more than one electrically conductive brush 190 may be provided between each pair of adjacent booms. For example, another electrically conductive brush 190 may be provided on sides of the intermediate extension boom 125 and the end-most extension boom 124 opposite those shown in FIG. 8 with electrically conductive brushes 190.

FIG. 8 illustrates conductive brushes 190 coupled to an inner-most boom of the adjacent pairs. However, the configuration may be reversed. That is, the conductive brushes 190 may be coupled to an outer-most boom of the adjacent pairs. Additionally, the conductive brushes 190 may be generally of the same configuration, but different in size, for instance, sized based on the size and/or space of the adjacent booms. For example, the size of some or all of the components of the conductive brushes 190 may decrease from the conductive brush 190 between the end-most extension boom 124 and the intermediate extension boom 125 down the boom structure 120 to the conductive brush 190 between the intermediate extension boom 125 and the base boom 123.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A mobile telescoping crane comprising:

a carrier having a plurality of wheels or treads;

a superstructure rotatably coupled to a top portion of the carrier about a vertical axis; and a telescoping boom structure rotatably coupled to the superstructure about a horizontal axis, the telescoping boom structure being configured to extend in a first direction to a fully extended state and retract in a second direction opposite the first direction to a fully retracted state, and including a metal base boom and a plurality of metal extension booms arranged concentrically and spaced apart from each other;

a boom tip coupled to an end-most extension boom of the plurality of metal extension booms; and a load assembly coupled to the boom tip, wherein the telescoping boom structure further includes:

at least one first electrically conductive contact provided in a space between the metal base boom and an adjacent metal extension boom of the plurality of metal extension booms, the at least one first electrical conductive contact being configured to maintain contact with the metal base boom and the adjacent metal extension boom so as to maintain electrical continuity between the metal base boom and the adjacent metal extension boom in the fully extended state, the fully retracted state, and any state of the telescoping boom structure between the fully extended state and the fully retracted state, and at least one second electrically conductive contact provided in respective spaces between adjacent metal extension booms of the plurality of metal extension booms, the at least one second electrically conductive contact being configured to maintain contact with the adjacent metal extension booms so as to maintain electrical continuity between the adjacent metal extension booms in the fully extended state, the fully retracted state, and any state of the telescoping boom structure between the fully extended state and the fully retracted state, and wherein the telescoping boom structure is configured to provide a predictable, continuous ground path for current from the telescoping boom structure to at least the superstructure for an external high voltage source applied to the telescoping boom structure.

2. The mobile telescoping crane of claim 1, wherein the at least one first electrically conductive contact includes at least two electrically conductive contacts provided in the space between the metal base boom and an adjacent metal extension boom, and wherein each said at least one second electrically conductive contact includes at least two electrically conductive contacts provided in the respective spaces between adjacent metal extension booms of the plurality of metal extension booms.

3. The mobile telescoping crane of claim 1, wherein each of the at least one first electrically conductive contact and each of the at least one second electrically conductive contact is a bearing media configured to provide a bearing for telescoping operation of the telescoping boom structure.

4. The mobile telescoping crane of claim 3, wherein each said bearing media includes at least one electrical insulation portion and at least one electrical conductive portion to provide the electrical continuity.

5. The mobile telescoping crane of claim 3, wherein each said bearing media includes a plurality of conductive fibers having a constitution to form an electrical conductor to provide the electrical continuity.

6. The mobile telescoping crane of claim 1, wherein the at least one first electrically conductive contact has a first end tethered to the metal base boom and a second end that is untethered, but maintains contact with the metal base boom and the adjacent metal extension boom so as to maintain electrical continuity between the metal base boom and the adjacent metal extension boom.

7. The mobile telescoping crane of claim 1, wherein each of the at least one second electrically conductive contacts has a first end tethered to an outermost one of the adjacent metal extension booms and a second end that is untethered, but maintains electrical continuity between the adjacent metal extension booms.

8. The mobile telescoping crane of claim 1, wherein each of the at least one first electrically conductive contact and the at least one second electrically conductive contact is removably coupled in the telescoping boom structure.

9. The mobile telescoping crane of claim 1, wherein each of the at least one first electrically conductive contact and the at least one second electrically conductive contact includes one or more of a conducting wheel assembly, an electrically conductive stud or studs, a conductive wear pad, a tethered cable, a conductive brush, and conductive grease.

10. A telescoping boom comprising:

first boom segment;

a second boom segment inwardly spaced from the first boom segment, the second boom segment being nestable within a first inner volume of the first boom segment and movable between a fully extended position and a fully retracted position relative to the first boom segment;

a third boom segment inwardly spaced from the second boom segment, the third boom segment being nestable within a second inner volume of the second boom segment and movable between a fully extended position and a fully retracted position relative to the second boom segment;

at least one first electrically conductive contact provided between the first boom segment and the second boom segment; and at least one second electrically conductive contact provided between the second boom segment and the third boom segment, wherein the at least one first electrically conductive contact is fixed to at least one of the first boom segment and the second boom segment and configured to maintain an electrical conduction path between the first boom segment and the second boom segment in the fully extended position, the fully retracted position, and any position between the fully extended position and the fully retracted position, wherein the at least one first electrically conductive contact is configured to provide a predictable, continuous ground path for current from the first boom segment to the second boom segment for an external voltage applied to either the second boom segment or the third boom segment, wherein the at least one second electrically conductive contact is fixed to at least one of the second boom segment and the third boom segment and configured to maintain an electrical conduction path between the second boom segment and the third boom segment in the fully extended position, the fully retracted position, and any position between the fully extended position and the fully retracted position, and wherein the at least one second electrically conductive contact is configured to provide a predictable, continuous ground path for current from the third boom segment to the second boom segment for the external voltage applied to the third boom segment.

11. The telescoping boom of claim 10, wherein the at least one electrically conductive contact is fixed to the first boom segment and the second boom segment.

12. The telescoping boom of claim 10, wherein the at least one electrically conductive contact is fixed to only one of the first boom segment and the second boom segment.

13. The telescoping boom of claim 10, wherein the at least one electrically conductive contact is a support element between the first boom segment and the second boom segment.

14. The telescoping boom of claim 10, wherein the at least one electrically conductive contact is always between an inner surface of the second boom segment and an outer surface of the first boom segment.

15. The telescoping boom of claim 10, wherein the at least one electrically conductive contact has at least one electrical insulation portion and at least one electrical conductive portion to provide the electrical conduction path between the first boom segment and the second boom segment.

16. A plurality of electrically conductive contacts for a telescoping boom having a first boom segment, and a second boom segment inwardly spaced from the first boom segment, and a third boom segment inwardly spaced from the second boom segment, wherein a first one of the electrically conductive contacts comprises:

a body having:

a first side configured to make a first electrical connection with the first boom segment, and a second side configured to make a second electrical connection with the second boom segment, wherein a second one of the electrically conductive contacts comprises:

a body having:

a first side configured to make a third electrical connection with the second boom segment, and a second side configured to make a fourth electrical connection with the third boom segment, wherein the first electrical connection and the second electrical connection form a first predetermined portion of a ground path, from the second boom segment to the first boom segment, upon energization of the second boom segment caused by an external energization source applied to the second boom segment and/or the third boom segment, and wherein the third electrical connection and the fourth electrical connection form a second predetermined portion of the ground path, from the third boom segment to the second boom segment, upon energization of the third boom segment caused by the external energization source applied to the third boom segment.

17. The electrically conductive contacts of claim 16, wherein, for the first electrically conductive contact of the electrically conductive contacts, the second side is configured to be mechanically coupled to the second boom segment, and the first side is configured to be spaced from the first boom segment by an air gap.

18. The electrically conductive contacts of claim 16, wherein, for the first electrically conductive contact of the electrically conductive contacts, the body is configured to provide a mechanical bearing between the first boom segment and the second boom segment.

19. The electrically conductive contacts of claim 16, wherein each of the electrically conductive contacts is one of a conducting wheel assembly, an electrically conductive stud or studs, a conductive wear pad, a tethered cable, and a conductive brush.

* * * * *